United States Patent [19]

Aluotto

[11] Patent Number: 4,968,033

[45] Date of Patent: Nov. 6, 1990

[54] ADJUSTABLE FINGER GRIP HOLE FOR BOWLING BALLS

[76] Inventor: Peter A. Aluotto, 1668 Hendrickson St., Brooklyn, N.Y. 11234

[21] Appl. No.: 443,879

[22] Filed: Nov. 30, 1989

Related U.S. Application Data

[60] Division of Ser. No. 281,809, Dec. 8, 1988, abandoned, and a continuation-in-part of Ser. No. 281,809, Dec. 8, 1988, abandoned.

[51] Int. Cl.[5] ..... A63B 37/00

[52] U.S. Cl. ..... 273/63 A; 273/63 B

[58] Field of Search ..... 273/63 A, 63 B, 63 R

[56] References Cited

U.S. PATENT DOCUMENTS

| | | | |
|---|---|---|---|
| 447,011 | 2/1891 | Harman | 273/63 A |
| 673,688 | 5/1901 | Pickett | 273/63 A |
| 2,210,528 | 8/1940 | Darby | 273/63 B |
| 2,372,958 | 4/1945 | Keith | 273/63 B |
| 2,842,367 | 7/1958 | Keith | 273/63 B |
| 2,844,375 | 7/1958 | Nestor | 273/63 B |
| 3,861,681 | 1/1975 | Kelsey | 273/63 B |
| 4,561,654 | 12/1985 | Haza | 273/63 B |
| 4,778,178 | 10/1988 | Haza | 273/63 B |

*Primary Examiner*—George J. Marlo

*Attorney, Agent, or Firm*—Kane, Dalsimer, Sullivan, Kurucz, Levy, Eisele & Richards

[57] ABSTRACT

An adjustable finger grip hole for a bowling ball is disclosed. The finger grip hole, designed for installation within the opening drilled into the ball, is a nested set of three cup-like receptacles. The middle receptacle of the set moves axially in the space between the others to adjust the size of the opening formed by the innermost receptacle. In an alternate embodiment, inner cups of varying size are substituted within an outer cup to effect the finger grip hole adjustment. The interiors of the inner cups can also be pitched at a predetermined angle with respect to the axis of the inner cup, and the rims of both inner and outer cups may be provided with notched markings to facilitate the reproducible angular positioning of the inner cup.

5 Claims, 3 Drawing Sheets

FIG. 1
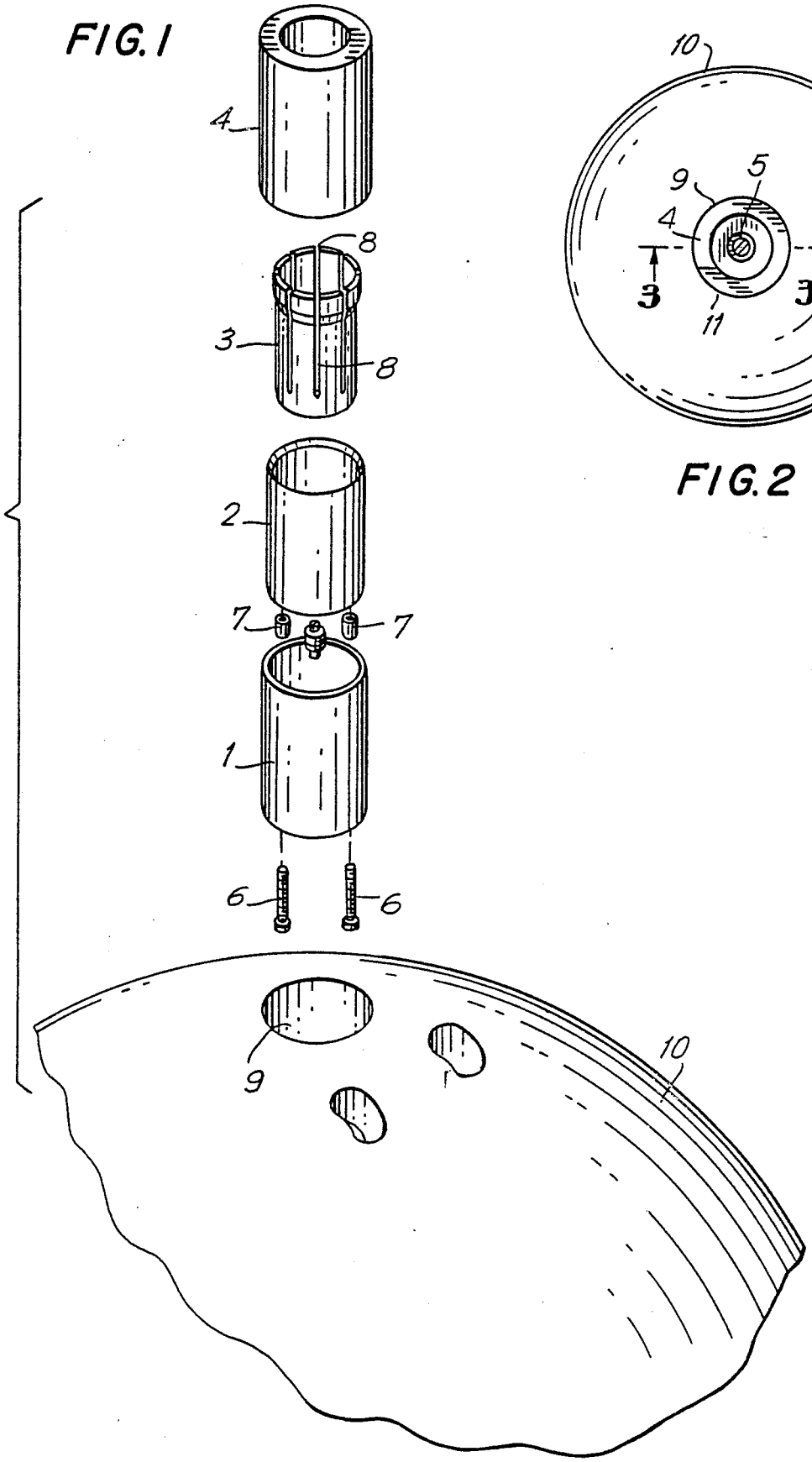
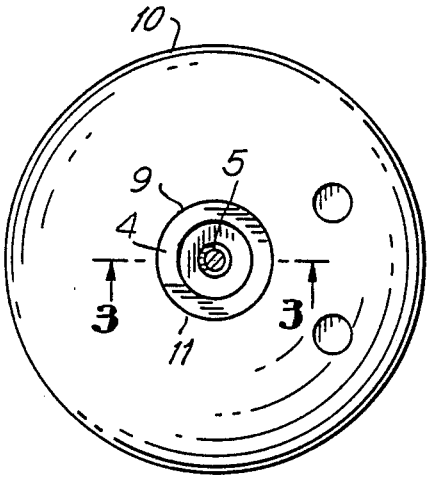
FIG. 2

ADJUSTABLE FINGER GRIP HOLE FOR BOWLING BALLS

CROSS-REFERENCE TO RELATED APPLICATION

The present application is both a division and a continuation-in-part of U.S. Patent Application Ser. No. 281,809, filed on Dec. 8, 1988, now abandoned.

BACKGROUND OF THE INVENTION

1. Field of the Invention

The present invention relates to the finger grip holes provided in bowling balls to enable bowlers to accurately and safely propel them down a bowling alley. More specifically, it provides a mechanical device which, when inserted into a hole drilled in a bowling ball, will enable any bowler to adjust its diameter to comfortably match that of his own finger.

2. Description of the Prior Art

The sport of bowling is known and played by millions around the world. For those, however, who are for some reason unacquainted with this pastime, the object of a game of bowling is to knock down as many of the ten upright, vaguely bottle-shaped, wooden bodies, commonly referred to as pins, standing at the far end of a wood-floored alley or lane, as possible by rolling a dense, heavy bowling ball at them. Score is kept during the game according to well-established rules. A perfect score has the value "300"and is achieved in the relatively unlikely event that the bowler knocks down all ten pins each time he rolls or throws in the game.

We will be concerned here with the ball, which, as has already been noted, is heavy and dense, as it would have to be to knock down the pins standing at the far end of the alley by virtue of its momentum. Further, the ball is of a diameter that makes it virtually impossible to be handled safely with one hand. As a solution to this difficulty, and to avoid the necessity of propelling the ball with an awkward, two-handed motion, holes are drilled into the bowling ball for the insertion of the fingers of the bowler's preferred hand. Most often, three such holes, for a thumb and two fingers, are drilled, defining a triangle on the surface of the ball. Using them, the bowler can propel the ball down the alley in a fluid, one-handed motion toward the target pins.

The diameters of the holes are chosen to accommodate the fingers of the user. When one becomes enthusiastic enough about participating in this sport, he purchases a ball of his own and has holes drilled into the body thereof to fit the thickness of his fingers. This, however, presents a far from ideal situation because most other people will not be able to use that ball as the holes will be the wrong size for their own fingers. Moreover, the owner of the ball himself will find that his fingers will not always fit the holes as well as he might like. The situation is most acute for the novice bowler who, perhaps not owning a bowling ball, must search through those available at the bowling establishment to find one that gives the best fit. Compromise in this regard is unavoidable.

Clearly, the problems illustrated above would find a solution in a bowling ball having holes whose diameters could be adjusted. Such a solution is provided by the present invention.

SUMMARY OF THE INVENTION

The present invention provides a mechanical device, designed to be inserted into a hole drilled into a bowling ball, for regulating the inside diameter of a finger gripping hole. As such, it will provide bowlers with an adjustable finger grip hole and a solution to the problems noted above.

In its most general form, the device comprises an outer cup designed to be secured within a hole drilled into a bowling ball. Within the outer cup is secured an inner cup, whose inside diameter can be varied. In one embodiment, the inside diameter of the inner cup is varied by a mechanical means employing a middle cup which moves between the inner and outer cups. In another embodiment, the inner cup can be changed for another of different inside diameter. The finger grip hole accordingly is adjusted by substituting inner cups of different inside diameter.

In a variation of this last embodiment, the inner cup may be provided with a pitch at an angle to its axis. In other words, there may be a slight angle provided between the axis of the cylindrical cavity of the inner cup and the axis of the inner cup as a whole. The inner cup can then be secured within the outer cup with this pitch oriented in any desired direction: for example, forward, backward, left, or right. Inner cups having different pitch angles may be provided to accommodate the needs of different bowlers in this regard.

The present invention will be clearly and completely described below with particular reference to the accompanying diagrams.

BRIEF DESCRIPTION OF THE DRAWINGS

FIG. 1 shows an exploded perspective view of the preferred embodiment of the present invention and a bowling ball with which it is to be used.

FIG. 2 shows a perspective view of the bowling ball from above showing the adjustable finger grip hole in its intended position.

FIG. 8 is a perspective view taken from above of a bowling ball which includes an alternate embodiment of the adjustable finger grip hole.

FIG. 9 is a section view of the alternate embodiment of the adjustable finger grip hole shown in FIG. 8, and taken along line 9—9 in that figure.

FIG. 10 is a further section view of the alternate embodiment of the adjustable finger grip hole shown in FIG. 9, and taken along line 10—10 in that figure.

DETAILED DESCRIPTION OF THE PREFERRED EMBODIMENTS

Figure 3:
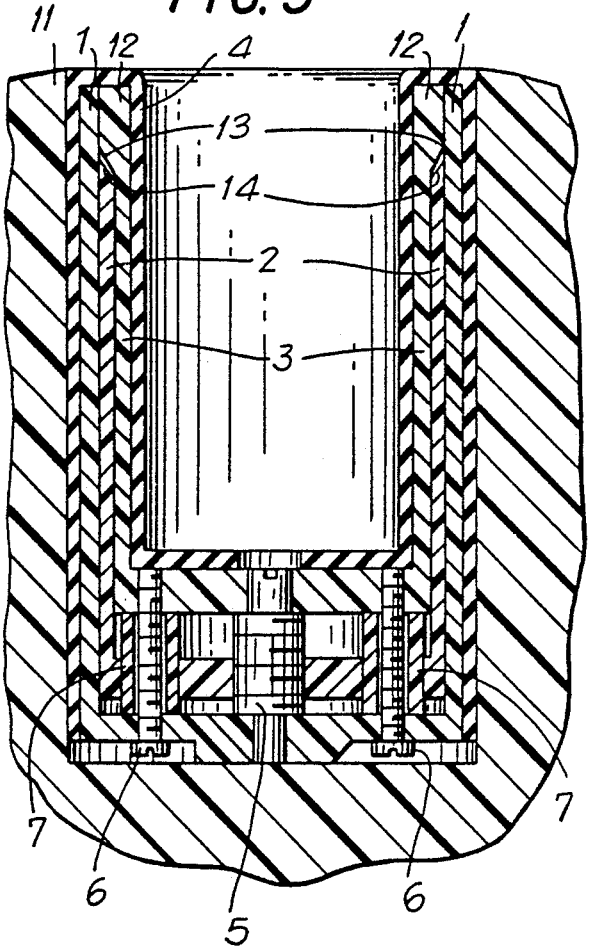
FIG. 3 is a section view taken as indicated in FIG. 2 showing the adjustable finger grip hole at its widest setting.

With reference to the accompanying figures, a bowling ball is shown beneath an exploded view of the preferred embodiment of the adjustable finger grip hole 11 of the present invention in FIG. 1. According to its design, the adjustable finger grip hole is intended to be fixed more or less permanently by being glued within the hole. Its inner diameter can be adjusted quite simply and readily in a manner that will be explained below.

In this preferred embodiment, the components of the adjustable finger grip hole, as shown in FIG. 1, are an outer cup 1, a middle cup 2, and an inner cup 3, a rubber silicone shell 4, a lead screw 5, and a pair of connecting screws 6 and associated spacers 7. As can be seen, the inner cup is split with a plurality of longitudinal gaps 8.

In FIG. 2, the adjustable grip hole 11 is shown assembled and installed in what would be considered the thumb hole 9 of the bowling ball 10. It is of course necessary that the depth of the thumb hole 9, or any other hole in which the invention is installed, is exactly chosen so that the top of the adjustable finger grip hole is flush with the surface of the bowling ball 10. As one looks down into the adjustable finger grip hole 11 in the thumb hole 9 of FIG. 2, one sees the top of the lead screw 5, cut with a slot to accommodate the head of a screwdriver. In this way, the diameter of the adjustable finger grip hole 11 can be adjusted.

The operation of the adjustable finger grip hole 11 will now be described with reference to FIG. 3, which is a section view taken as indicated in FIG. 2. The device can be seen to include the three cups 1,2,3 in a nested relationship. The inner cup 3 and the outer cup 1 are in fixed positions with respect to each other. This condition is assured by the manner in which they are connected. A pair of screws 6 pass up through the bottom of the outer cup 1 and threadingly engage with the bottom of the inner cup 3. The space between the bottoms of the inner and outer cups is fixed by the spacers 7 through which the screws also pass.

For the most part, there is a gap between the sides of the inner cup 3 and the outer cup 1, except at the top of the inner cup 3, where there is an outwardly thickened rim 12. The outwardly thickened rim 12 is bevelled inward, as shown by the bevel 13, some distance below the top opening.

The sides of the inner cup are split by a plurality of longitudinal, axial gaps 8. This permits the sides to move radially inward or outward to bring about the adjustment of the diameter of the finger grip hole 11.

An axially movable middle cup 2 is disposed in the space between the inner cup 3 and the outer cup 1. The movement of the middle cup 2, and the consequent adjustment of finger grip hole diameter, occurs with the rotation of the lead screw 5, which rotates freely in holes provided through the bottoms of the inner cup 3 and outer cup 1, but is threadingly engaged with the bottom of the middle cup 2. Rotation of the lead screw 5 with an allen key or screwdriver inserted down into the adjustable finger grip hole raises or lowers the middle cup 2 relative to the inner and the outer cup 1. Rotation of the middle cup 2 along with that of the lead screw 5 is prevented by the screws 6 and spacers 7 passing through its bottom to connect the inner cup 3 and the outer cup 1. The middle cup 2 has a rim with an inward bevel 14.

FIG. 3 shows the adjustable finger grip hole 11 set to its widest diameter. If the lead screw 5 is rotated a sufficient number of times, the adjustable finger grip hole 11 will assume the configuration shown in FIG. 4.

Figure 4:
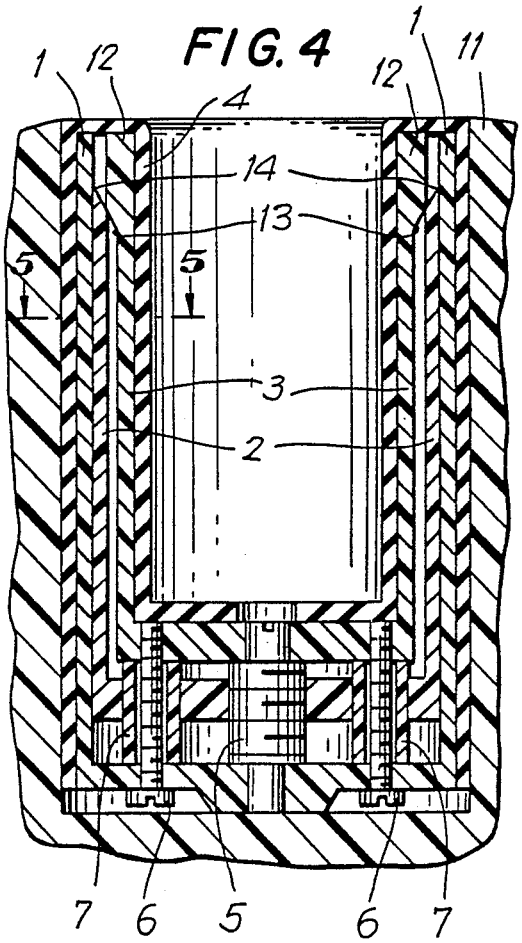
FIG. 4 is a section view like that provided in FIG. 3 showing the adjustable finger grip hole at its narrowest setting.

FIG. 4 corresponds to the narrowest diameter of the hole. As the adjustment required to bring the configuration shown in FIG. 3 to that shown in FIG. 4 is being made, the middle cup 2 is raised until the inward bevel 14 on its upper rim engages with the bevel 13 on the rim of the inner cup 3. The continued raising of the middle cup 2 will force the side of the inner cup 3 radially inward. The presence of longitudinal, axial gaps 8 in the side of the inner cup 3 permits this, thereby bringing about the desired adjustment.

The adjustable finger grip hole is covered with a rubber silicone shell 4. This prevents the gaps in the inner cup 3 from possibly injuring the finger inserted in the hole. At the very least, it makes the device more comfortable to use. The rubber silicone shell 4 is provided with a hole through which the adjustment of the lead screw 5 can be made without removing the entire adjustable finger grip hole from the bowling ball, as seen in FIG. 2.

Figure 5:
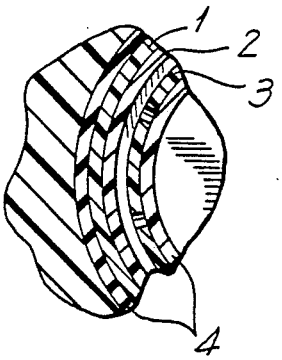
FIG. 5 is a section view taken as indicated in FIG. 4 showing the nestled relationship of the components of the adjustable finger grip hole.

FIG. 5 is a section view taken as indicated in FIG. 4 showing the nested relationship of the components of the adjustable finger grip hole 11.

Figure 6:
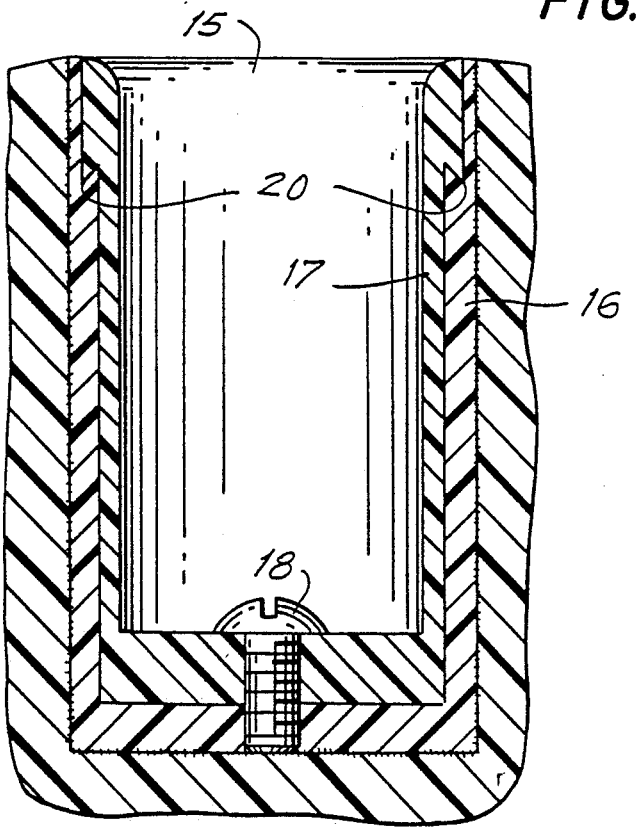
FIG. 6 is a section view of an alternative embodiment adjustable finger grip hole installed within a hole drilled into a bowling ball.
Figure 7:
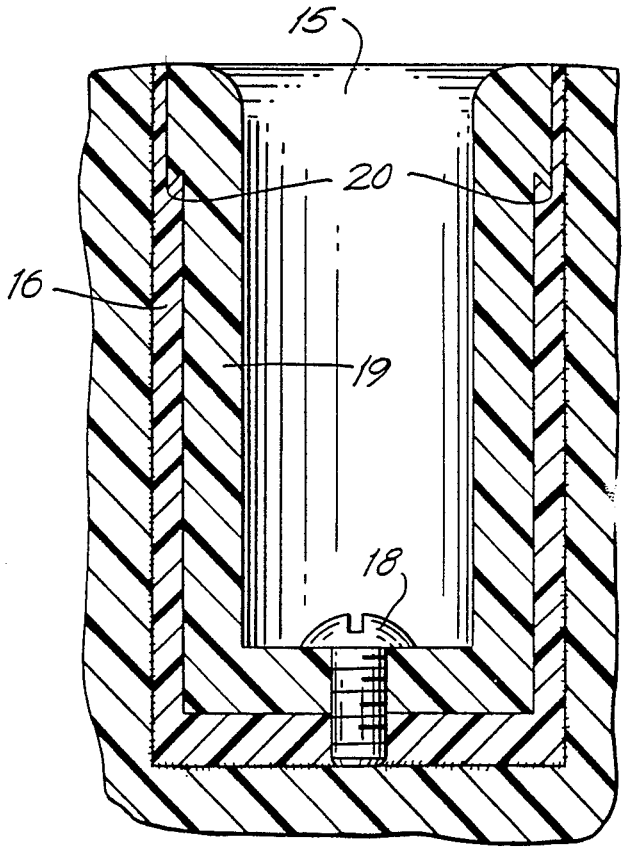
FIG. 7 is a section view of the alternative embodiment shown in FIG. 6 with an inner cup of narrower inside diameter.

FIGS. 6 and 7 show section views of an alternate embodiment adjustable finger grip hole 15. This embodiment comprises an outer cup 16, secured more or less permanently by being glued in a hole drilled into a bowling ball. An inner cup 17 of fixed inner diameter is then secured within the outer cup 16 by a screw 18 or similar means. The adjustment of finger grip hole diameter is carried out by substituting the inner cup 17 with another inner cup 19 of different inside diameter, as can be seen by comparing FIGS. 6 and 7. As shown in both FIGS. 6 and 7, the outer cup 16 and the inner cups 17,19 are provided with an interlocking ridge 20 which, in addition to screw 18, secures inner cups 17,19 within outer cup 16 and prevents them from shifting transversely therein.

FIG. 8 is a perspective view of a further embodiment of the present invention, in which the inner cup is pitched at an angle to its axis, taken from a vantage point above the bowling ball 10. The rim of the outer cup 16 has a single notch 22 for reference purposes. The rim of the inner cup 21 can have any number of notches 23 so that the azimuthal setting of the inner cup 21 may be reproducibly made. For example, four such settings can be provided on the rim so that the pitch of the inner cup 21 can be reproducibly set in the forward, backward, left, and right directions. Advantageously, these notches 23 can be marked F,B,L, and R, respectively, as shown in FIG. 8.

FIG. 9 shows a section view of the further embodiment 9 of the present invention shown in FIG. 8, taken along line 9—9 in that figure. In this embodiment, the inner cup 21 has a predetermined interior which is set at an angle with respect to the axis of the inner cup 21 as a whole. Specifically, the axis of the inner cup 21 as a whole is indicated by dashed line 24, and that of the cylindrical interior is indicated by dashed line 25. The dashed lines 24,25 are pitched at a small angle $\theta$ with respect to one another. As the inner cup 21 can be exchanged for one of different diameter in the same way as was previously discussed, it is considered within the scope of the present invention to have inner cups 21 where the pitch angle $\theta$ takes on different values.

FIG. 10 is another section view of the further embodiment of the present invention and is taken along line 10—10 in FIG. 9. As before, the outer cup 16 is fixed within the bowling ball 10. The screw 18 secures the inner cup 21 within the outer cup 16 and, when tightened, prevents the rotation of the inner cup 21 within the outer cup 16. Because the interior of the inner cup 21 is pitched at a slight angle, it appears offset with respect to screw 18 in this section view. Tightening of the screw 18 maintains the pitch in the direction preferred by the bowler.

Modifications to the above would be obvious to those skilled in the related arts without departing from the scope of the appended claims.

What is claimed is:

1. An adjustable finger grip hole for gripping an object comprising:

an outer cup-like receptacle securable within a hole in an object, said outer cup-like receptacle having an inner surface;

a replaceable inner cup-like receptacle of fixed inner diameter within said outer cup-like receptacle and temporarily securable therein, said inner cup-like receptacle having an outer surface and an interior into which a finger may be inserted;

said outer cup-like receptacle and said inner cup-like receptacle having rims which are visible on a surface of said object when said adjustable finger grip hole is installed in said object;

means for temporarily securing said inner cup-like receptacle within said outer cup-like receptacle, said outer surface of said inner cup-like receptacle being in contact with said inner surface of said outer cup-like receptacle; and means for interlocking said inner cup-like receptacle within said outer cup-like receptacle to prevent said inner cup-like receptacle from shifting transversely within said outer cup-like receptacle.

2. An adjustable finger grip hole as claimed in claim 1 wherein said means for temporarily securing said inner cup-like receptacle within said outer cup-like receptacle is a screw.

3. An adjustable finger grip hole as claimed in claim 1 wherein said means for interlocking said inner cup-like receptacle within said outer cup-like receptacle are complementary ridges on said inner surface of said outer cup-like receptacle and on said outer surface of said inner cup-like receptacle respectively.

4. An adjustable finger grip hole as claimed in claim 1 wherein said interior of said inner cup-like receptacle is pitched at a predetermined angle with respect to the axis of said inner cup-like receptacle.

5. An adjustable finger grip hole as claimed in claim 4 wherein said rim of said outer cup-like receptacle has a notch and said rim of said inner cup-like receptacle has a plurality of notches so that said inner cup-like receptacle can be reproducibly positioned to be pitched in a desired direction.

* * * * *